US005535559A

United States Patent [19]

Nielsen et al.

[11] Patent Number: 5,535,559

[45] Date of Patent: Jul. 16, 1996

[54] VENTILATING DEVICE FOR MOUNTING IN A PLASTICS FOIL OR A SIMILAR FLEXIBLE MATERIAL

[75] Inventors: Henning Z. Nielsen, Roskilde; Peter Sølbeck, Rungsted Kyst, both of Denmark

[73] Assignee: Polysheet A/S, Herlev, Denmark

[21] Appl. No.: 290,882

[22] PCT Filed: Mar. 4, 1993

[86] PCT No.: PCT/DK93/00086

§ 371 Date: Aug. 18, 1994

§ 102(e) Date: Aug. 18, 1994

[87] PCT Pub. No.: WO93/18254

PCT Pub. Date: Sep. 16, 1993

[30] Foreign Application Priority Data

Mar. 5, 1992 [DK] Denmark ..... 0299/92

[51] Int. Cl.[6] ..... E04D 13/17; E04H 15/14

[52] U.S. Cl. ..... 52/199; 52/198; 52/219; 285/189; 454/271; 454/366

[58] Field of Search ..... 52/198, 199, 218, 52/219, 244; 454/366, 367, 271, 275; 285/189, 202, 205

[56] References Cited

U.S. PATENT DOCUMENTS

| | | | |
|---|---|---|---|
| 2,664,809 | 1/1954 | Morell | 454/271 |
| 2,764,929 | 10/1956 | Tegarty | 454/271 |
| 2,907,592 | 10/1959 | Bailey | 285/219 |
| 3,325,193 | 6/1967 | Castello | 285/189 |
| 3,477,745 | 11/1969 | Williams et al. | 285/189 X |
| 3,892,169 | 7/1975 | Jarnot . | |
| 3,915,477 | 10/1975 | Timmons | 285/40 |
| 4,757,654 | 7/1988 | Korhonen et al. | 52/199 |
| 4,898,085 | 2/1990 | Jarnot | 454/275 |
| 5,094,049 | 3/1992 | Sells | 52/199 |

FOREIGN PATENT DOCUMENTS

| | | | |
|---|---|---|---|
| 116233 | 8/1984 | European Pat. Off. | 52/218 |
| 2-61258 | 3/1990 | Japan | 52/219 |
| 8504161 | 8/1988 | Sweden . | |
| WO82/02917 | 9/1982 | WIPO . | |

OTHER PUBLICATIONS

Damp–Vent Company Brochure, Bettendorf, Iowa, Mar. 1952.

*Primary Examiner*—Carl D. Friedman
*Assistant Examiner*—Laura A. Saladino
*Attorney, Agent, or Firm*—Beveridge, DeGrandi, Weilacher & Young

[57] ABSTRACT

A pipe-shaped ventilating device having a collar for mounting in a plastic foil or a similar flexible material, e.g. a water-tight foil placed on the rafters of a roof construction in order to provide for circulation from the air space under the foil, is formed to be mounted by a spiral movement around the edge of an opening shaped in the foil. The collar is provided with an upper wall and a lower wall, of which the latter is provided with a slit obliquely directed towards the pipe.

13 Claims, 3 Drawing Sheets

VENTILATING DEVICE FOR MOUNTING IN A PLASTICS FOIL OR A SIMILAR FLEXIBLE MATERIAL

The invention relates to a ventilating device for mounting in a plastic foil or a similar flexible material for ventilating an air space under the foil and comprising a comparatively short pipe with a collar around one end thereof.

Without being limited to this purpose, the invention especially aims at providing a simple and easily mountable ventilating device to be mounted in a water-tight foil positioned under a roof covering in order to ventilate the air space under such foil against the roof covering.

Due to leaks in a roof covering a water-tight foil is often placed below the covering when it is impossible to tighten the roof covering from the inside because of an internal insulation. In such places in the roof where trimmings for e.g. skylights or chimneys are provided for and where the passage of the air from the air space below the foil to the roof covering is consequently impeded, a venthole has to be mounted in order to create sufficient ventilation for avoiding dew which might seep through the layers of the roof.

From the Danish Published Specification No. 147365 a ventilating device of the kind referred to above is known in which a layer of a weather-resisting adhesive has been applied to the underside of the collar turning away from the pipe.

This known ventilating device is mounted in the wanted place by glueing it on the upper side of the foil and then cutting away the covered area of the foil inside the ventilating device. Besides creating circulation from the underside of the foil to the roof covering, through the leaks of which the air will then escape into the atmosphere, the ventilating device will effectively prevent rainwater, seeping down the foil under the roof covering, from penetrating through the foil where the ventilating device has been placed as the water will thus run round the ventilation device.

However, mounting this known ventilating device is a rather time-consuming operation, and in practice it has been found that under certain conditions, e.g. when the foil is stiff with cold, moist or is smudgy, it is difficult to make the adhesion between the foil and the collar of the ventilating device sufficiently watertight to avoid water seeping through the foil.

From U.S. Pat. No. 3,892,169 a rather complicated embodiment is known, in which the ventilating device comprises a lower collar which is placed in the foil from the underside thereof and is coupled with a collar element which is mounted from the outer side of the foil and to which the ventilating pipe stub is secured. The coupling of two seperate elements, which have to be mounted from either side of the foil makes the mounting difficult.

These drawbacks are avoided with the ventilating device according to the invention, which is characterized in that the collar comprises an upper wall and a lower wall firmly connected therewith to be placed on either side of the foil around an opening therein corresponding to the light opening of the pipe, and that the lower wall of the collar is provided with a slit obliquely directed towards the pipe for mounting the ventilating device from one side of the foil by means of a spiral movement.

A ventilating device according to the invention will be further explained by means of the drawing, in which FIGS. 1 and 2 in perspective shows an embodiment of the ventilating device, from the upper side and the lower side, respectively;

The ventilating device 4 comprises an obliquely cut pipe 10 of weather-resisting plastic material with a collar 11 mounted at a right angle to the pipe on the end opposite the oblique cut.

Figure 1:
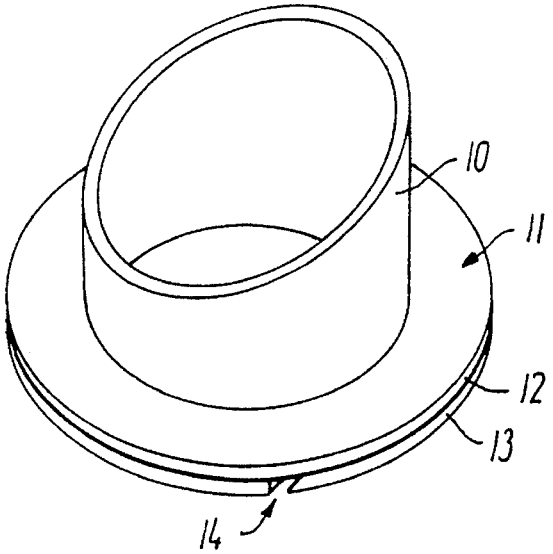
Figure 2:
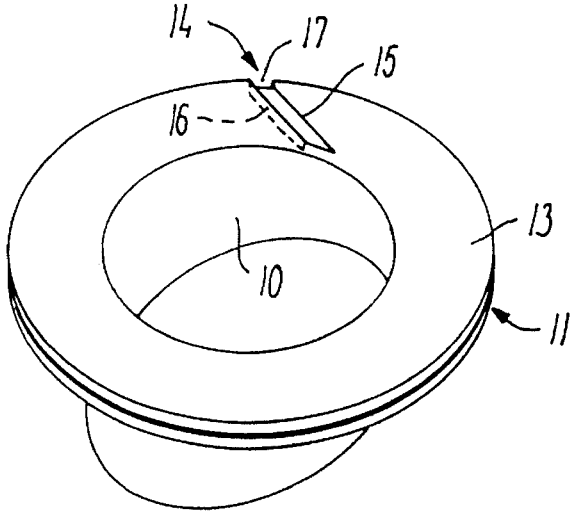
Figure 3:
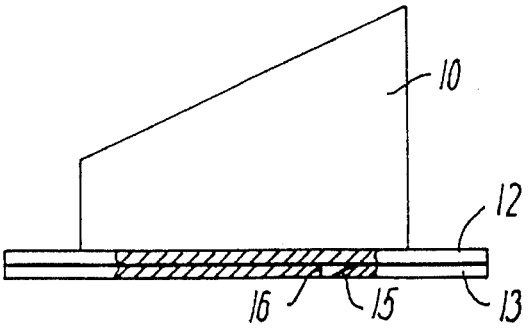
FIG. 3 is a cross-sectional view of the slit in the collar of the ventilating device.

As will be seen from FIGS. 1–3, the collar 11 is double-walled having an upper wall 12 and a lower wall 13 with a narrow interspace for mounting the ventilating device on the upper wall 12 and the lower wall 13 on either side of the foil, not shown.

For mounting the ventilating device in an opening in the foil which is made by cutting a circular hole corresponding to the inner light opening of the pipe 10, an obliquely directed slit 14 is provided in the lower wall 13 of the collar 11, which slit in the embodiment shown runs substantially tangentially towards the pipe 10. As illustrated in FIG. 3, the pipe is comparatively short. For example, the pipe extends off from the collar for a distance that is shorter than a maximum cross-sectional length of the collar (which is the diameter of the collar in the embodiment of FIG. 3).

To facilitate the mounting where the ventilating device by means of the slit 14 in the lower wall 13 is mounted by a spiral movement on the border of the foil around the circular opening, the slit 14 has an outer wall 15 and an inner wall 16 which diverge against the peripheral mouth 17 of the slit. Preferably, the outer wall 15 may also be rounded towards the peripheral mouth 17 and be obliquely positioned in relation to the plane of the collar, in order to more easily insert its edge at the underside of the lower wall 13 under the underside of the foil.

Figure 4:
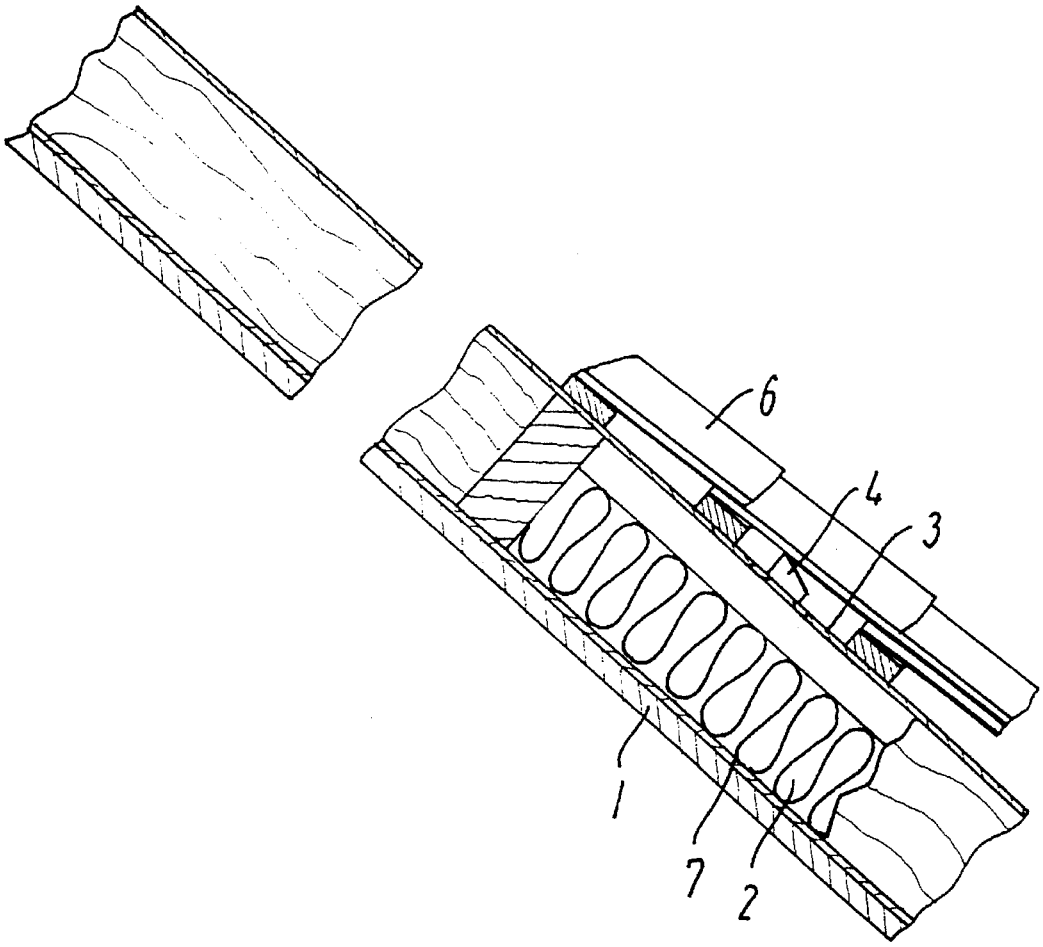
FIG. 4 shows the ventilating device placed in a roof covering.

In FIG. 4 the ventilating device 4 is shown mounted on a foil 3 below a roof covering 6, but above an insulating layer 2, a membrane 7 and an inner covering 1. The ventilating device may be produced in several sizes. Having a diameter of 75 mm it is, however, most applicable as according to need you will often have to mount several ventilating devices. Two ventilating devices mounted above and under, respectively, a skylight, a chimney or similar trimmings will be sufficient for keeping the roof construction free from dew and provide for a natural pressure equalization.

As mentioned above the ventilating device according to the invention is not limited to the use of ventilating the space under an underroof foil as shown in FIGS. 1–4. As a matter of fact the ventilating device according to the invention may be mounted in any foil material or similar flexible material, e.g. a tarpaulin cloth, for instance in connection with a tent construction of the kind described in Applicant's not yet published Danish patent application No. 412/92.

Figure 5:
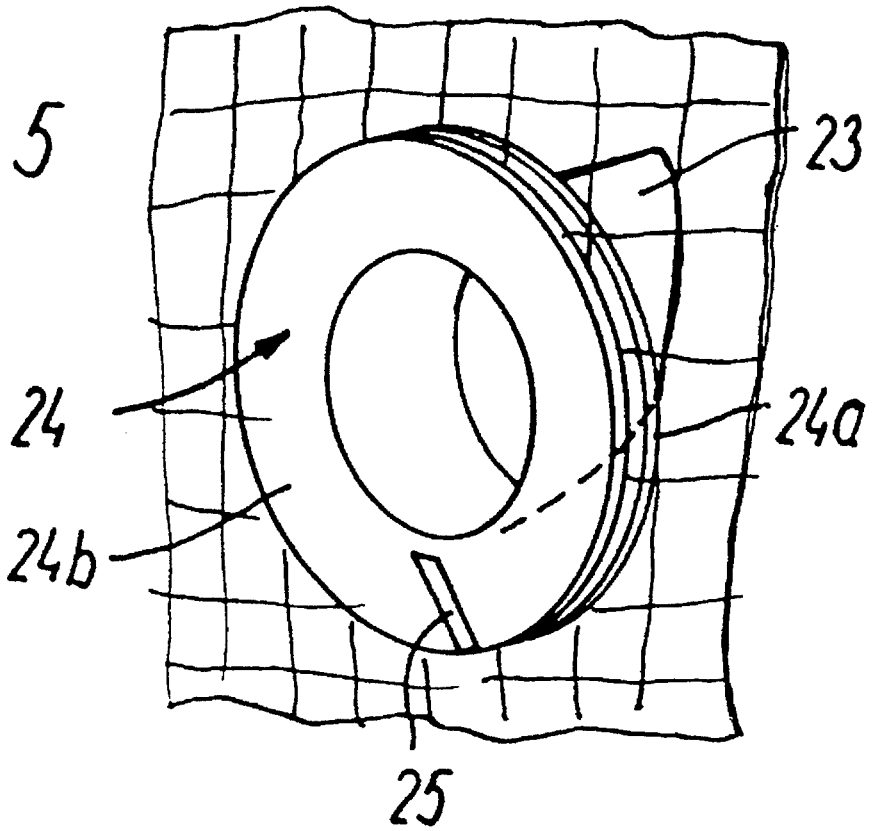
FIG. 5 shows the ventilating device mounted in a vertical wall of reinforced plastic material.

FIG. 5 illustrates the mounting of the ventilating device into a reinforced plastic material, which might constitute the end wall of such tent construction.

The ventilating device comprises an obliquely cut pipe stub 23 connected with a collar element 24 which is mounted in a prefabricated opening in the foil material corresponding to the light opening of the pipe stub 23, the collar 24 comprising an upper wall **24*a* and a lower wall 24*b* of which the latter is provided with an obliquely directed slit 25** so that the pipe stub may be mounted by a spiral movement without needing to be glued.

We claim:

1. A ventilating device for mounting in a plastic foil or a similar flexible material for ventilating an air-filled space below the foil, comprising a pipe with a collar around one end thereof, said collar comprising an upper wall and a lower wall firmly connected therewith to be placed on either side of the foil around an opening therein corresponding to an internal opening of the pipe, the lower wall of the collar being provided with a slit having a mouth at a periphery of the collar and said slit being directed substantially tangentially towards the pipe for mounting the ventilating device from one side of the foil by a spiral movement.

2. A ventilating device as claimed in claim 1 wherein said slit has walls which diverge towards said mouth.

3. A ventilating device as claimed in claim 2, wherein an outer wall of the slit is rounded towards said peripheral mouth and is obliquely positioned in relation to the plane of the collar.

4. A ventilating device as claimed in claim 2, wherein said ventilating device is dimensioned for mounting in a water-tight foil position a prespecified distance below a roof covering, and wherein said pipe is of a shorter length than said prespecified distance between the foil and the roof covering to circulate air from an air-filled space below the foil towards the roof covering.

5. A ventilating device as claimed in claim 1 wherein an outer wall of the slit is rounded towards said peripheral mouth and is obliquely positioned in relation to the plane of the collar.

6. A ventilating device as claimed in claim 5, wherein said ventilating device is dimensioned for mounting in a water-tight foil positioned a prespecified distance below a roof covering, and wherein said pipe is of a shorter length than said prespecified distance between the foil and the roof covering to circulate air from an air-filled space below the foil towards the roof covering.

7. A ventilating device according to claim 1 wherein said ventilating device is dimensioned for mounting in a water-tight, underroof foil positioned a prespecified distance below a roof covering, and wherein said pipe is of a shorter length than said prespecified distance between the foil and the roof covering in order to circulate air from an air-filled space below the foil towards the roof covering.

8. A ventilating device as recited in claim 1 wherein said pipe extends off from said collar for a distance that is shorter than a maximum cross-sectional length of said collar.

9. A ventilating device for mounting in a plastic foil or a similar flexible material for ventilating an air-filled space below the foil, comprising a pipe with a collar around one end thereof, said collar comprising an upper wall and a lower wall firmly connected therewith to be placed on either side of the foil around an opening therein corresponding to an internal opening of the pipe, and that the lower wall of the collar is provided with a slit having a mouth at a periphery of the collar and with said slit being obliquely directed towards the pipe for mounting the ventilating device from one side of the foil by a spiral movement, and wherein an outer wall of the slit is rounded towards said mouth and is obliquely positioned in relation to the plane of the collar.

10. A ventilating device as claimed in claim 9 wherein said slit runs substantially tangentially towards the pipe.

11. A ventilating device as claimed in claim 10, wherein said slit has walls which diverge towards said mouth at the periphery of the collar.

12. A ventilating device as claimed in claim 11, wherein said ventilating device is dimensioned for mounting in a water-tight foil positioned a prespecified distance below a roof covering, and wherein said pipe is of a shorter length than said prespecified distance between the foil and the roof covering to circulate air from an air-filled space below the foil towards the roof covering.

13. A ventilating device as recited in claim 9 wherein said pipe extends off from said collar for a distance that is shorter than a maximum cross-sectional length of said collar.

* * * * *